US009691406B2

(12) United States Patent
Jax et al.

(10) Patent No.: US 9,691,406 B2
(45) Date of Patent: Jun. 27, 2017

(54) METHOD FOR ENCODING AUDIO SIGNALS, APPARATUS FOR ENCODING AUDIO SIGNALS, METHOD FOR DECODING AUDIO SIGNALS AND APPARATUS FOR DECODING AUDIO SIGNALS

(71) Applicant: Dolby Laboratories Licensing Corporation, San Francisco, CA (US)

(72) Inventors: Peter Jax, Hannover (DE); Alexander Krueger, Hannover (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 16 days.

(21) Appl. No.: 14/896,383

(22) PCT Filed: May 27, 2014

(86) PCT No.: PCT/EP2014/060959
§ 371 (c)(1),
(2) Date: Dec. 5, 2015

(87) PCT Pub. No.: WO2014/195190
PCT Pub. Date: Dec. 11, 2014

(65) Prior Publication Data

US 2016/0125890 A1 May 5, 2016

(30) Foreign Application Priority Data

Jun. 5, 2013 (EP) ..... 13305756

(51) Int. Cl.
*G10L 19/24* (2013.01)
*G10L 19/008* (2013.01)
(Continued)

(52) U.S. Cl.
CPC ..... *G10L 19/24* (2013.01); *G10L 19/008* (2013.01); *G10L 19/038* (2013.01); *H04S 3/008* (2013.01); *H04S 2420/11* (2013.01)

(58) Field of Classification Search
CPC ..... G10L 19/24; G10L 19/20; G10L 19/008; G10L 19/038; G10L 19/04; G10L 19/06; H04S 3/008; H04S 2420/11
(Continued)

(56) References Cited

U.S. PATENT DOCUMENTS

2014/0249827 A1* 9/2014 Sen ..... G10L 19/008 704/500
2014/0355769 A1* 12/2014 Peters ..... G10L 19/20 381/23
2015/0341736 A1* 11/2015 Peters ..... H04S 7/30 381/17

FOREIGN PATENT DOCUMENTS

EP 2469741 6/2012

OTHER PUBLICATIONS

Burnett et al., "Encoding Higher Order Ambisonics with AAC", 124th AES Convention, New York, May 2008; pp. 1-8.
(Continued)

*Primary Examiner* — Vivian Chin
*Assistant Examiner* — Jason R Kurr

(57) ABSTRACT

The invention introduces a new concept for hierarchical coding of HOA content. A method for encoding a hierarchical audio bitstream comprises rendering a HOA input signal to surround sound, encoding the surround sound for a base layer output signal, decoding the encoded surround sound to obtain a reconstructed surround sound signal, performing dimensionality reduction on the received HOA input signal, calculating a residual between the dimensionality-reduced HOA signal and the reconstructed surround sound signal, encoding the residual signal, and multiplexing
(Continued)

structural information about the HOA input signal, the encoded residuals and the encoded surround sound into a bitstream to obtain a hierarchical audio bitstream.

15 Claims, 5 Drawing Sheets

(51) Int. Cl.
*G10L 19/038* (2013.01)
*H04S 3/00* (2006.01)

(58) Field of Classification Search
USPC ..... 381/22, 23, 92
See application file for complete search history.

(56) References Cited

OTHER PUBLICATIONS

Hellerud et al., "Spatial redundancy in Higher Order Ambisonics and its use for low delay lossless compression", IEEE International Conference on Acoustics, Speech and Signal Processing, Piscataway, USA, Apr. 19, 2009, pp. 269-272.
Anonymous, "Draft Use Cases, Requirements and Evaluation Procedures for 3D Audio", 99. MPEG Meeting, Feb. 6-10, 2012, San Josa CR, ISO/IEC JTC1/SC29/WG11, No. N12610; pp. 1-12.
Wuebbolt et al., "Thoughts on Draft Use Cases; Requirements and Evaluation Procedures for 3D Audio", 100. MPEG Meeting, 30.04. 2012-4.5.2012, Geneva, ISO/IEC JTC1/SC29/WG11, No. m46864; pp. 1-8.
Search Report Dated Jul. 11, 2014.

* cited by examiner

Overall architecture of hierarchical HOA encoding for available surround sound data

METHOD FOR ENCODING AUDIO SIGNALS, APPARATUS FOR ENCODING AUDIO SIGNALS, METHOD FOR DECODING AUDIO SIGNALS AND APPARATUS FOR DECODING AUDIO SIGNALS

This application claims the benefit, under 35 U.S.C. §365 of International Application PCT/EP2014/060959, filed May 27, 2014, which was published in accordance with PCT Article 21(2) on Dec. 11, 2014 in English and which claims the benefit of European patent application No. 13305756.2, filed Jun. 5, 2013.

FIELD OF THE INVENTION

This invention relates to a method for encoding audio signals, an apparatus for encoding audio signals, a method for decoding audio signals and an apparatus for decoding audio signals.

BACKGROUND

Compression of Higher-Order Ambisonics (HOA) content has not been deeply explored in the scientific literature. Therefore, this section will introduce an exemplary state-of-the-art monolithic architecture for self-contained compression of HOA content. It has been verified by extensive testing that this architecture enables high-quality coding of high-resolution spatial sound scenes at medium-level (e.g. 256 kbit/s) to high-level (e.g. 1.5 Mbit/s) data rates. The background information provided in this section is necessary for understanding the hierarchical concepts build upon this architecture.

FIG. 1 illustrates the concept for self-contained HOA compression from an encoder perspective. Note that the numbers and parameters provided in the figure are exemplary. For instance, the codec architecture is shown here for encoding of $4^{th}$ order HOA content (N=4), which requires $(N+1)^2=25$ equivalent audio channels for a full 3D representation. The same concept can be used for encoding of any HOA order from N=1 upwards. Likewise, the number 8 of extracted "audio channels" after dimensionality reduction is an exemplary number that shall highlight the order of magnitude—however, this number of 8 (on average) has been found suitable when encoding HOA content of order N=4.

The encoding process is divided into two stages which are to some extent independent from each other. The first stage 10 is a dimensionality reduction stage. It analyzes the input HOA content and reduces the signal dimension by decomposing it into a lower number of dominant sound components. The somewhat abstract term "sound components" is used because the resulting signals not necessarily correspond to sound objects, specific spatial directions or ambience—although they can in fact do so in special cases.

From information theory it is known that, at least for complex audio scenes, the information provided at the output of this stage 10 is systematically less than the input information. The dimensionality reduction stage 10 operates in such a manner that (1) the information loss is minimized, by exploiting inherent redundancy of the input audio scene as much as possible, and that (2) irrelevancy is reduced, i.e. the output signal still carries enough information such that the perceptual difference of a reconstructed audio scene compared to the input content is minimized. This stage 10 employs time-variant and signal-adaptive signal processing.

The number of its output signals can be adaptive as well, depending on the parameterization as well as on signal characteristics.

The second encoding stage 11 comprises a bank of several (in this case 8) parallel perceptual encoders for monaural audio signals. These encoders encode the individual dominant sound components and operate using the principles of time-frequency coding that have been well-established since the 1990s. For instance, a bank of MPEG-4 Advanced Audio Coding (AAC) encoders could be utilized at the second encoding stage 11. The encoder implementations need to be slightly modified in order to enable the global coder control block to influence certain parameters of these core codecs such as average bit rate, window switching behavior, size of bit reservoir, behavior of spectral band replication, etc. This architecture has been chosen since it minimizes the design effort required for implementing a HOA codec by facilitating, to the maximum extent possible, the reuse of existing codec implementations and corresponding optimizations.

The operation of the full encoder is controlled by the coder control stage 12. Here, a perceptual audio scene analysis is performed which determines the parameters that are required in order to drive and control the other signal processing stages. In particular, this control instance is responsible for global optimization of data rate resources, and it is crucial for achieving a strong overall rate-distortion performance. Finally, resulting bit streams of the second encoding stage 11 and side information from the coder control stage 12 are multiplexed 13 into a single output bit stream.

SUMMARY OF THE INVENTION

It would be desirable to encode HOA content in a way that allows at least a basic compatibility with other/surround sound formats. One problem of the architecture shown in FIG. 1 is that it is only applicable for HOA formatted signals. The present invention introduces a new concept, method and apparatus for hierarchical coding of HOA content, which results in a bitstream that is backward compatible with surround sound formats.

In particular, the present invention discloses solutions for encoding high-resolution spatial audio content in a hierarchical bitstream that is backward compatible with other existing surround sound decoders. The resulting bitstream decodes to conventional surround sound if conventional surround sound decoders are utilized, while a new, enhanced decoder according to one embodiment of the invention is able to decode the very same bitstream to full 3D audio (i.e. more than surround sound). In principle, the bitstream comprises a base layer and an enhancement layer. During both encoding and decoding, information from the surround sound representation is exploited for encoding/decoding the high-quality audio signal of the enhancement layer.

A method for decoding a hierarchical audio bitstream is disclosed in claim 1.

A method for encoding a hierarchical audio bitstream is disclosed in claim 2.

An apparatus for decoding a hierarchical audio bitstream is disclosed in claim 3, and an apparatus for encoding a hierarchical audio bitstream is disclosed in claim 5.

In one embodiment, the invention relates to a computer readable storage medium having stored executable instructions that, when executed on a computer, cause the computer to perform a method for decoding according to claim 1. In one embodiment, the invention relates to a computer readable storage medium having stored executable instructions that, when executed on a computer, cause the computer to perform a method for decoding according to claim 2.

In one embodiment, the invention relates to a device comprising a processor and a memory, the memory having stored executable instructions that, when executed on the processor, cause the processor to perform a method for decoding according to claim 1. In one embodiment, the invention relates to a device comprising a processor and a memory, the memory having stored executable instructions that, when executed on the processor, cause the processor to perform a method for decoding according to claim 2.

In one embodiment, a method for decoding a hierarchical audio bitstream comprises steps of demultiplexing the hierarchical audio bitstream to obtain an embedded surround sound bitstream and a $2^{nd}$ layer HOA bitstream, the $2^{nd}$ layer HOA bitstream comprising first and second side information and encoded residual signals, decoding the embedded surround sound bitstream to obtain a decoded surround sound bitstream, and decoding the $2^{nd}$ layer bitstream. In decoding the $2^{nd}$ layer bitstream, a reconstructed HOA signal is obtained by predicting sound components using the decoded surround sound bitstream and the first side information, superposing the predicted sound components with the decoded residual signals to obtain reconstructed sound components, and reconstructing HOA content by recomposing the reconstructed sound components and the second side information.

An advantage of the invention is that it allows encoding HOA content in a way that allows at least a basic compatibility with other formats, including surround sound formats.

It has to be noted that a full implementation of a hierarchical codec according to the invention may rely on any available modifiable encoder and decoder blocks for the bank of core codecs, and may use different core codecs than those described below.

Advantageous embodiments of the invention are disclosed in the dependent claims, the following description and the figures.

BRIEF DESCRIPTION OF THE DRAWINGS

Exemplary embodiments of the invention are described with reference to the accompanying drawings, which show in FIG. 1 the structure of a known encoder architecture for HOA compression.

DETAILED DESCRIPTION OF THE INVENTION

Figure 1:
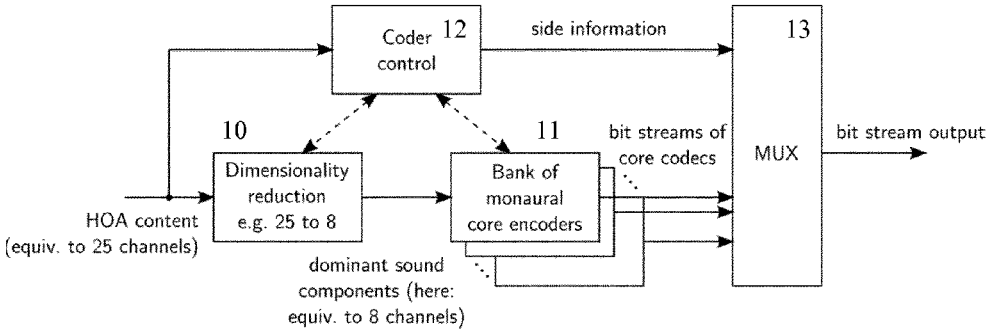

The present invention provides an embedded coding scheme approach for Higher Order Ambisonics (HOA) content. A very attractive application for such a scheme is distribution/broadcasting of high-resolution spatial audio content with a bitstream that is backward compatible to existing surround sound decoders. This kind of bitstream decodes to conventional surround sound if existing surround sound decoders are utilized, while a new, enhanced decoder is able to decode full 3D audio from the very same bitstream. Thereby, a "chicken-egg problem", which usually significantly decelerates a large-scale deployment of new monolithic (or self-contained) content formats and corresponding decoder implementations, can be circumvented. Content providers can start distributing a new quality of content that advantageously still enjoys basic support by a large number of decoders installed in the field, i.e. at potential customers.

The aforementioned application is effectively addressed by hierarchical coding technologies: an embedded surround sound bitstream is self-contained in general, but serves as a bitstream container that also carries the "extra information" required for a full 3D audio scene. The key for high-efficiency compression of the full audio scene under these constraints is that a maximum amount of information is exploited from the existing surround sound representation, in order to minimize the gross bit rate that is required in order to transport the full 3D audio scene at a given quality level.

The present invention introduces concepts and evaluations on how such compression technology can work, taking a specific focus towards compression of HOA content. HOA representations are particularly attractive in applications where a cost-efficient production workflow is required. Moreover, the HOA technology with its inherent scalability and independence from recording or loudspeaker configurations opens the door towards highly efficient delivery to the home and flexible rendering to all kinds of real-life loudspeaker configurations that may be present in consumers' homes.

As a concrete example, one may consider TV broadcasting where a gross bit rate for the audio part of the bitstream is in the order of magnitude of 128 kbits (stereo) to 384 kbits (surround). Such bit rates are already challenging if a complex spatial audio scene is to be compressed and transported, e.g. $4^{th}$ order HOA content. They are naturally even more challenging, if virtually the same gross data rate shall be used to transport a surround version plus the full spatial audio scene in decent quality. The invention introduces concepts that are applicable for resolving this challenge.

The exemplary state-of-art approach for self-contained HOA compression that was briefly introduced above sets the scene for understanding the new, hierarchical concepts of the invention.

The present description focuses on content originally recorded in HOA format ("original HOA content"), because of the advantageous characteristics of such content with respect to its suitability for efficient compression and rendering. Nevertheless, hierarchical compression technologies very similar to those described below can as well be applied for applications in which the original 3D audio scene representation uses channel-oriented and/or object-oriented paradigms.

In the following, the concept for hierarchical coding of HOA content is described. Optionally, original sound objects may be additionally input.

Figure 2:
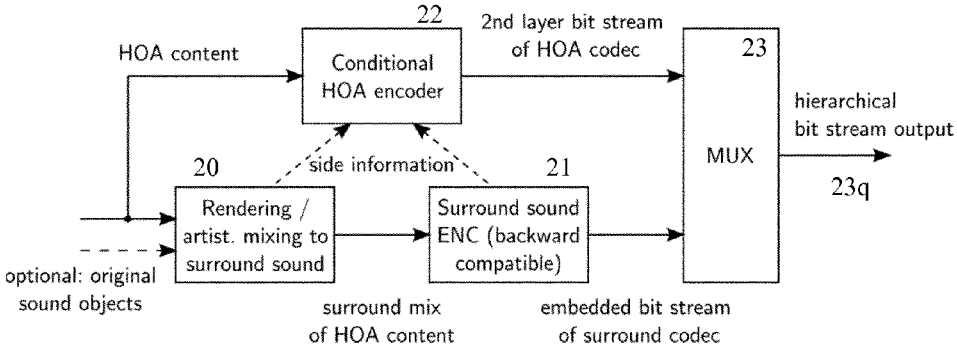
FIG. 2 an exemplary architecture for hierarchical HOA encoding with an embedded surround sound codec bitstream.

An illustration of the proposed embedded coding principle is shown in FIG. 2. The encoder uses two parallel signal paths, namely one for creation and encoding of the surround signal from the incoming HOA signal, and the other one for conditional coding of the HOA content: In the lower signal path, the incoming HOA signal is rendered 20 to the loudspeaker format of the embedded surround coder 21. This rendering can be implemented and controlled in a very flexible manner. For instance, a fully automatic rendering from the incoming HOA content can be performed, or sound mixers can create an artistic rendering. The rendering can be time-invariant or time-variant. In principle, the surround signals can also be created by a totally different mixing workflow than used for the original mixing of the HOA content. In general, however, the hierarchical compression scheme can only yield any rate-distortion advantage versus the simulcast transmission of a surround sound bitstream plus an HOA bitstream if at least some level of correlation between those two signal representations is available and can be utilized by the conditional coding block 22. This is usually the case, and is self-evident if the surround sound bitstream is obtained from the input HOA bitstream.

The surround sound loudspeaker format that the surround sound coder 21 uses for the embedded bitstream can follow any existing (or new future) surround format, e.g. traditional 5.1 surround, or any flavor of surround sound with a "reasonable" speaker configuration (such as e.g. a modified 5.1 surround sound format e.g. with different angles, or any 7.1 format, etc.). In general, it can be expected that, the more independent sound components are contained in the embedded surround signal, the more efficiency will be gained from the conditional coding block 22 introduced below. In a feasibility study, a traditional 5-channel surround configuration (with channels: left, center, right, left surround, right surround) was used.

The encoded surround channels are fully or partially decoded so that they can serve as side information for the conditional encoding of the HOA content. For the sake of simplicity, this surround channel decoding is not explicitly shown in FIG. 2 (but in FIG. 3 below). The conditional coding 22 identifies and utilizes as much correlation as possible between the surround channels and the HOA content in order to make compression of the HOA content more efficient. Further details on specific challenges and on how they can be resolved will be described below.

The encoded surround channels and the $2^{nd}$ layer (enhancement layer) bitstream provided by the conditional coding block 22 are multiplexed 23, and the final output bitstream 23*q* comprises the multiplexed sub-bitstreams from the two encoding blocks 21,22 in a scalable configuration. At its core is the bitstream of the embedded surround sound coder 21. This part of the bitstream is packaged in a backwards compatible manner, so that any existing decoder in the field that is compliant to the surround codec format will be able to understand and decode this part of the bitstream, while ignoring the extra bitstream of the HOA codec. In addition, the output bitstream 23*q* contains the bitstream generated by the conditional HOA encoder 22. In a truly hierarchical setup, this part of the bitstream is only decodable by decoder implementations according to the invention, which are aware of the full bitstream/codec format.

A prerequisite for the above-mentioned scalable (single-) bitstream definition is that the format specification of the surround codec bitstream to be enhanced is open for adding new sub bitstreams that are to be ignored by existing surround decoders. That is, the invention is applicable for surround sound formats that allow such addition. Most surround formats, like common 5.1 surround sound or 7.1 surround sound, fulfil this condition.

Figure 3:
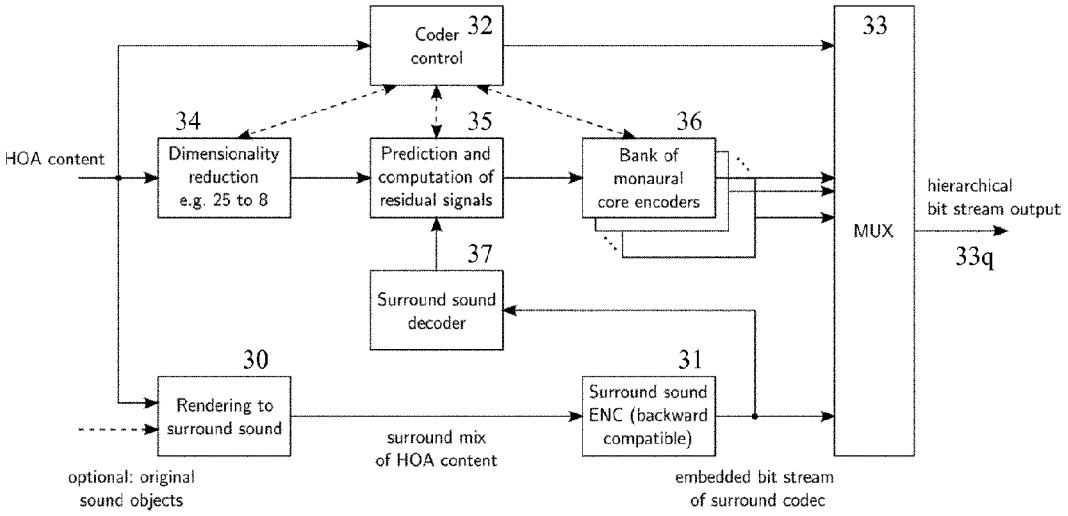
FIG. 3 hierarchical HOA encoding with prediction and residuum coding.

FIG. 3 shows a simplified block diagram of one embodiment of the conditional coding scheme for the encoding of HOA signals using information that can be derived from the embedded surround signals. The most obvious modification compared to the stand-alone HOA encoder shown in FIG. 1 is that a surround sound decoder 37 is added between the paths and a new sub-system 35 for prediction and computation of residual signals is added between the dimensionality reduction block 34 and the subsequent bank of core codecs (monaural core encoders) 36. This sub-system is, in this simplified view, the key for obtaining significant performance gains.

In principle, the new sub-system 35 for prediction and computation of residual signals acts as a predictor that uses information from the embedded surround signals in order to predict the dominant sound components produced by the dimensionality reduction block 34. The difference signals (named "residuum" or "residual signals" in the sequel) between the original dominant sound components and the predicted signals are then forwarded to the bank of parallel core encoders 36. These encode the residual signals into a surround format, e.g. Dolby Digital or 5.1 Surround Sound. Any kind of linear or non-linear prediction can be utilized, thereby allowing for a flexible trade-off between algorithm complexity and signal quality. It can be expected that if the prediction works better, the residual signals will have less signal energy and will require less data rate for decent compression at a given quality level. As described above, dominant sound components not necessarily correspond to sound objects, specific spatial directions or ambience.

The above-introduced principle of mere prediction is simplified because side information on the characteristics of the surround signals can also be exploited (additionally or exclusively) via conditional coding within the bank of core encoders 36, and this side information has to be used as well in global coder control as well as the individual core codecs for bit allocation. The prediction-only approach shown above has the benefit that it requires only minimal modification of the core encoders.

In the above-described prediction plus residuum coding principle, there are a few basic challenges that have to be taken care of:

First, the dimensionality of surround sound channels is typically lower than that of the HOA content. Hence, from an information theory perspective, it may appear unlikely that a perfect prediction of dominant sound components from the surround channels is feasible, unless the intrinsic dimension of both representations is limited, e.g. for purely synthetically mixed content. The amount of actually obtainable prediction gains will be evaluated below for a couple of typical sequences of content.

Second, the surround sound codec 31,37 introduces coding noise which is thus an ingredient of the side information that is input to the prediction block 35 for prediction of the HOA content. In contrast to the surround channels, though, the coding noise can be assumed uncorrelated with the useful signal as well as between the surround channels. Hence, the coding noise may add up in the residual signals while the gross level of the residual will be equal or lower than that of the original HOA content. Thereby, the SNR of the residual can suffer considerably from coding noise of the surround sound codec.

As an example, consider that the typical SNR of state-of-the-art perceptual audio coding is in the range of 10-20 dB, and even much worse if parametric coding schemes like spectral band replication (SBR) have been applied. According to the above-explained mechanism of noise addition, the SNR of the residual signals may be considerably lower than the aforementioned range. Consequently, there is a substantial risk that the residual coders waste data rate for encoding the coding noise of the surround layer rather than for useful signals.

Third, in perceptual compression of residual signals, a mismatch between the encoded signals and the masking signals has to be considered. While the residual signals may have lower signal levels than the original sound components provided by the dimensionality reduction, these sound components still have to be taken as the input for the psycho-acoustic modeling of masking thresholds. The principle of this architecture is shown in FIG. 4, as explained further below.

Furthermore, the dual kinds of quantization noise, one being produced by the embedded surround codec 31,37 as described above and the other being the result of the coding operations within the actual bank of residual encoders, have to be optimized by the bank of core codecs 36. Therefore, the hierarchical concept introduced above requires that the core codecs are modified versus stand-alone application of the same perceptual audio coding algorithms.

The feasibility study mentioned below shows results that have been obtained with the minimization of the frame-wise energy level of the residual signals being the optimization criterion for adapting the prediction step. This is a rather straight-forward optimization criterion that works well, provided the data rate is high enough and the power distribution is substantially homogeneous over different frequency ranges. Alternative optimization strategies that may be better in certain applications include minimization of differential or perceptual entropy metrics formulated in frequency or transform domain—which metric works out best depends heavily on the architecture of the integrated core codecs.

Figure 4:
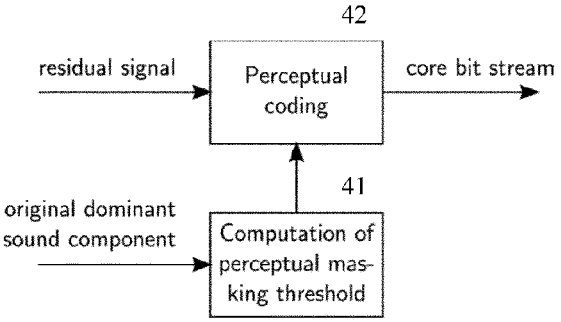
FIG. 4 modification of psycho-acoustics control of perceptual core codec.

FIG. 4 shows a modification of psycho-acoustics control of a perceptual core codec. The residual signals may have lower signal levels than the original sound components provided by the dimensionality reduction, but still the sound components have to be taken as the input for the psycho-acoustic modeling of masking thresholds. Thus, an individual perceptual masking threshold for each dominant sound component is computed 41 and used in perceptual coding 42 of the residual signal. This scheme has to be performed within all encoder entities of the bank of core encoders 36 in order to take advantage of the energy reduction of the residual signals in perceptual coding.

Naturally, the prediction scheme can be adapted on a frame basis, but also frequency-dependent schemes can be employed in order to optimize the impact of prediction for perceptual audio coding of the residual signals. Such frequency-dependent schemes are those that use frame-wise matrix operations (in the time domain) with different matrices for different frequency bands. In this way the trade-off between algorithm complexity and amount of side information (for prediction control in the decoder) on one side and quality level on the other side can be tuned.

Concerning side information, the following is to be considered.

Besides potential bit rate savings that can be obtained directly via the prediction concept, the parameters of the prediction block have to be transmitted as side information within the bitstream, such that the decoder can perform identical prediction steps for recovery of the uncompressed sound components. A worst-case assessment of the required data rate is as follows:

For the exemplary hierarchical HOA coding system depicted in FIG. 3, the prediction system may e.g. use a matrix of 5×8 coefficients in order to perform the prediction. The coefficients of the matrix have been updated for every frame of 1024 samples at a sample rate of 48 kHz, i.e. a total number of 5*8*50=2000 parameters per second have to be encoded and transmitted. If we assume a quantization with 8 bit per parameter, the resulting side information data rate would be about 16 kbit/s.

Feasibility of the above-described concept of hierarchical HOA coding with an embedded surround sound bitstream has been verified by conducting a series of experiments. In the following, the underlying constraints and assumptions are outlined, and the main results are highlighted via a few representative examples. For this purpose, the core blocks of the encoding system depicted in FIG. 3 have been implemented and/or simulated. For rendering of the incoming HOA content to 5-channel surround sound (left, center, right, left surround, right surround), a fixed rendering matrix was utilized that is also used for rendering HOA content directly to loudspeakers.

The impact of encoding and decoding of the surround sound has been simulated via adding uncorrelated noise at an average signal-to-noise ratio (SNR) of 10 dB. The "coding noise" simulated thus has been filtered with a linear prediction filter that has been adapted according to the frequency components of the original surround sound channels. Consequently, the frequency distribution of the coding noise roughly follows the power spectrum of the surround signals, though with a lower power level according to the specified SNR.

For the prediction scheme, a linear block prediction has been used that can be obtained from the covariance matrix of the joint vector between known signals (surround channels) and unknown signals (dominant sound components). This adaptation is relatively straight-forward and has been tuned for minimization of the mean-square prediction error. The adaptation is performed frame-by-frame with a frame advance of 1024 samples at a sample rate of 48 kHz.

As the objective evaluation metric, the component-wise prediction gain expressed in decibels was specified. This metric has the advantage that it can hint—albeit only for applications with high data rates (see below)—at corresponding rate-distortion improvements via the well-known 6 dB/bit rule of thumb: for instance at a prediction gain of 6 dB per sound component, it can be expected that the data rate required in order to transmit the residual for that component with a given quality is 1 bit/sample lower than for transmission of the original sound component. This rule can be translated to the present case based on the average prediction gain that is obtained for all of the (exemplarily) eight involved sound components: each prediction gain improvement of 1 dB yields theoretic data rate savings of up to roughly 64 kbit/s.

Results have been determined via a Monte Carlo scheme based on a set of representative sequences. Prediction gains have been determined for a few typical kinds of HOA signals, comprising synthetic mixes with different numbers of sound objects as well as various recordings that have been conducted with microphone arrays like the EigenMike in combination with diverse post processing workflows.

It is noted that, although the above assumptions are reasonable, they may apply only to a certain degree in practice. The likelihood of the above assumptions to be met in practical implementations depends strongly on characteristics of both the surround sound codec and the monaural core codecs. A more precise evaluation for a specific application may be performed with the actual codecs involved.

Figure 5:
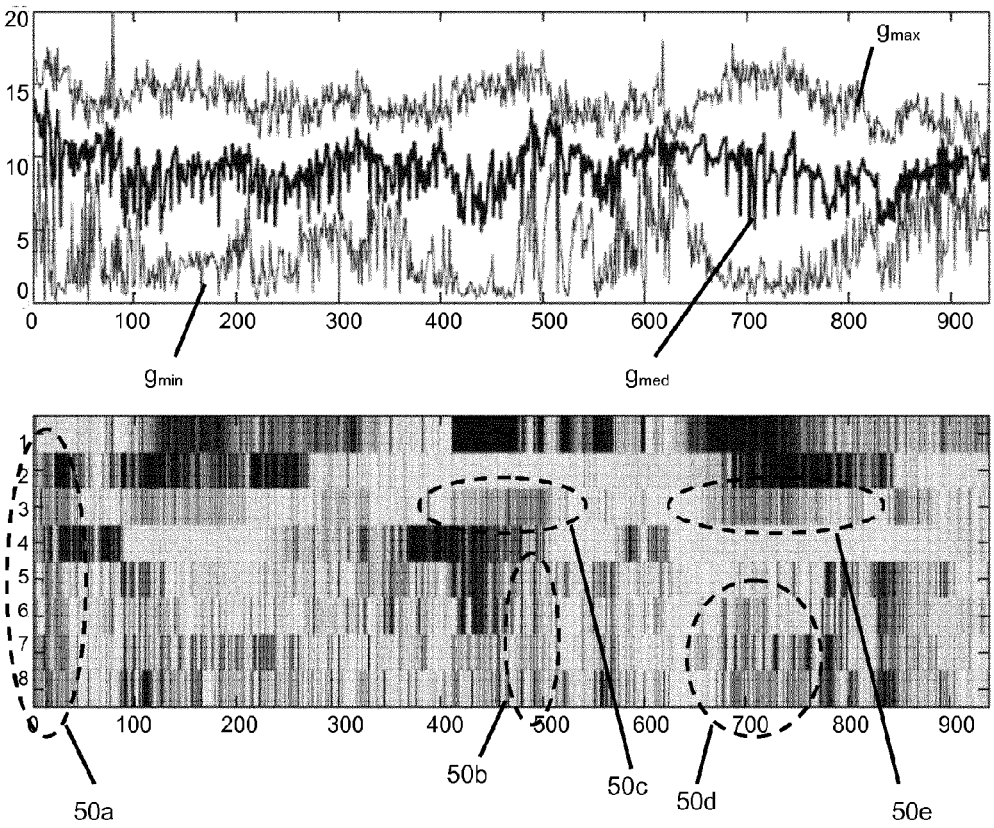
FIG. 5 time-dependent behavior of prediction gain for an exemplary HOA signal ("Bumblebee")

Exemplary evaluation results for an HOA sequence "Bumblebee" are depicted in FIG. 5, which shows time-dependent behavior of prediction gain for an exemplary HOA signal ("Bumblebee"). The upper diagram shows three curves corresponding to the mean prediction gain $g_{med}$, minimum prediction gain $g_{min}$ and maximum prediction gain $g_{max}$ obtained for each frame (horizontal axis). The lower diagram shows the frame-dependent prediction gain for each of eight dominant sound objects (each corresponding to one row on the vertical axis) for each frame (horizontal axis); small gains (0 dB) are dark (i.e. blue) and strong gains (20 dB) are red. The marked areas 50*a*,50*b*,50*c*,50*d*,50*e* are mainly red, i.e. show strong gains, while dark (blue) parts have small gains. In other areas, medium gain values dominate.

It is obvious from these results that the prediction gain is strongly time variant (but always positive), and that it depends on the type of content and/or dominant sound component to be coded. The latter finding is reflected in a drastically different behavior of the prediction that can be observed for different dominant sound components in the lower diagram of FIG. 5.

The overall mean prediction gain computed over the full "Bumblebee" sequence is 9.22 dB. Interestingly, the absolute value of 9.22 dB is close to the SNR of 10 dB that has been assumed for the embedded surround sound codec.

Figure 6:
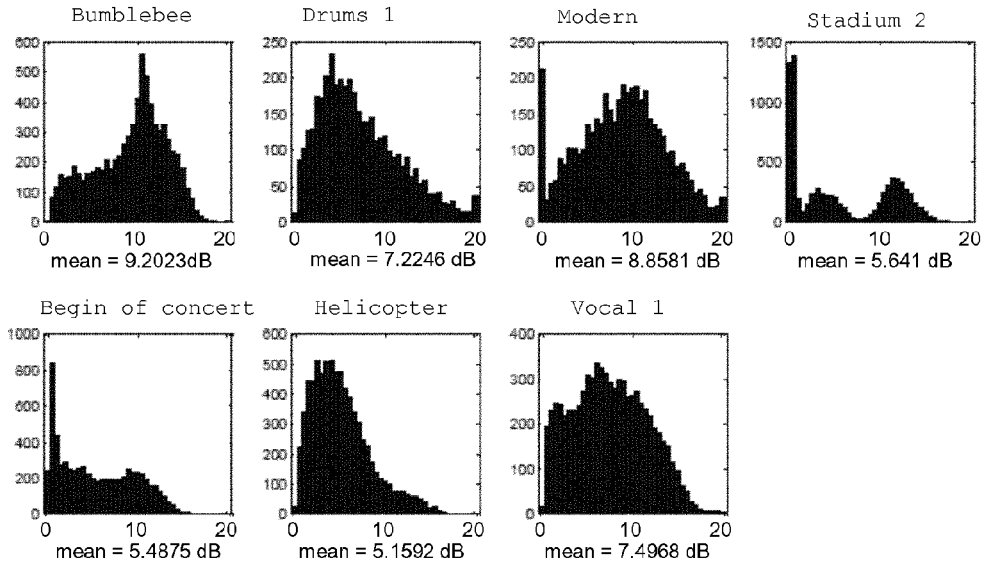
FIG. 6 histograms of global prediction gains for different kinds of HOA content.

A statistical evaluation of the prediction gains for several HOA signals is collected in FIG. 6. For each out of seven test sequences, a histogram of the obtained prediction gain is shown in steps of 0.5 dB. This evaluation highlights the different characteristics of the prediction gain for different types of content. For instance, a very interesting piece of content is the sequence "Stadium 2" which exhibits a three-modal histogram of prediction gains: while there are many frames and/or dominant sound components for which virtually no gain can be achieved at all, two other modes exist with mean values of roughly 3.5 dB and 11.5 dB. This histogram is a result of the specific recording and post processing technology used for this sequence: it was recorded in a sport stadium and is very diffuse, i.e. it has many uncorrelated sound sources.

The results of the feasibility study indicate a consistent prediction gain of 5-9 dB observed for various kinds of signals (microphone array recordings, synthetic mixes and hybrid signals). While the prediction gain of single signal frames may be better than the SNR simulated for the surround sound codec, none of the average values goes beyond the value of 10 dB. Obviously, the SNR of the surround sound codec poses a constraint on the maximum prediction gain that can be achieved. This finding is supported by experiments in which the simulated SNR of the surround sound codec has been varied with similar observations.

Besides the average prediction gain, it becomes clear from the evaluation results that the prediction gain is highly time-variant and that the statistics of the prediction are strongly dependent on the kind of signal under test. In practical applications, a powerful bit reservoir technology as well as smart global bit rate control would likely help addressing the strong time variance. The term bit reservoir technology means a technology that distributes available bits over time, depending on the signal to be encoded; it requires keeping bits in reserve for the future part of the signal.

Under high-rate assumptions (i.e. assuming that high bit-rate is available, so that the 6 dB assumption mentioned above is valid) and with the rule of thumb motivated above (64 kbit/s of bit rate savings per dB of prediction gain), the identified level of prediction gains would translate to up to 320-576 kbit/s of savings compared to simulcast transmission without prediction. This result is at least meaningful for near-lossless compression applications, because then the high-rate assumptions hold to a large extent. Note that for an evaluation of lossless compression of all HOA coefficients, a different study has to be performed, because the "dimensionality reduction" step will not be required in this case.

Low-rate audio compression behaves differently than high-rate compression, and it is unlikely that under such requirements the same amount of bit rate saving can be realized as identified above. Such low-rate system can be built for a more precise evaluation. For such low-bit-rate evaluation, it is particularly essential to include a few modifications in the bank of core codecs.

Nevertheless, the above result shows that it appears reasonable to assume that hierarchical coding has significant benefits over simulcast transmission of surround sound and HOA content. The above-mentioned prediction gains and associated potential data rate reductions seem particularly meaningful for applications where the gross bit rate is in the medium range of roughly 500 kbit/s. In such applications, the amount of potential data rate savings matters a lot, but still we are closer to high-rate assumptions than for very low bit rate applications.

Figure 7:
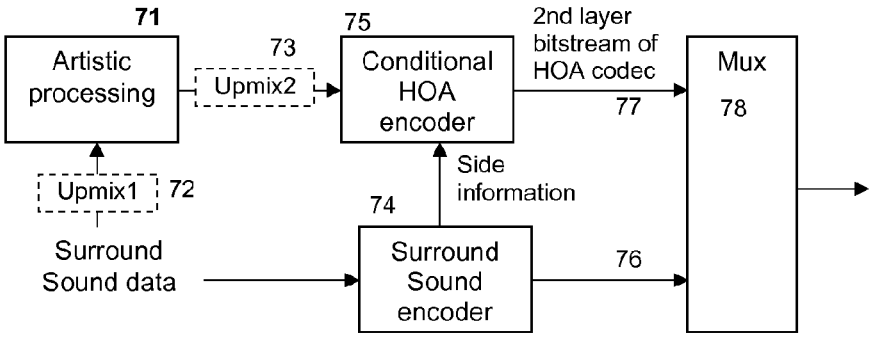
FIG. 7 an exemplary architecture of hierarchical HOA encoding where surround sound data are already available.

FIG. 7 shows an exemplary architecture of hierarchical HOA encoding where surround sound data are already available. Thus, it is not possible nor required to derive the surround data from an HOA signal. Instead, artistic processing 71 may be performed on the available surround sound data, e.g. additional voices, environmental sound, audience applause etc. may be added. An upmix 72,73 may be performed either before or after the artistic processing 71 in order to obtain a HOA representation thereof (or both if a double upmix is performed). The surround sound is encoded in a Surround sound encoder 74, which provides also side information resulting from the surround sound content. The HOA representation is conditionally encoded in a Conditional HOA encoder 75, depending on the side information, to obtain a $2^{nd}$ layer bitstream of residual HOA content. Finally, the encoded surround sound 76 and the $2^{nd}$ layer bitstream of residual HOA content 77 are put into a hierarchical bitstream, e.g. in a multiplexed manner using a multiplexer 78. Further details are similar as shown in FIG. 3.

Figure 8:
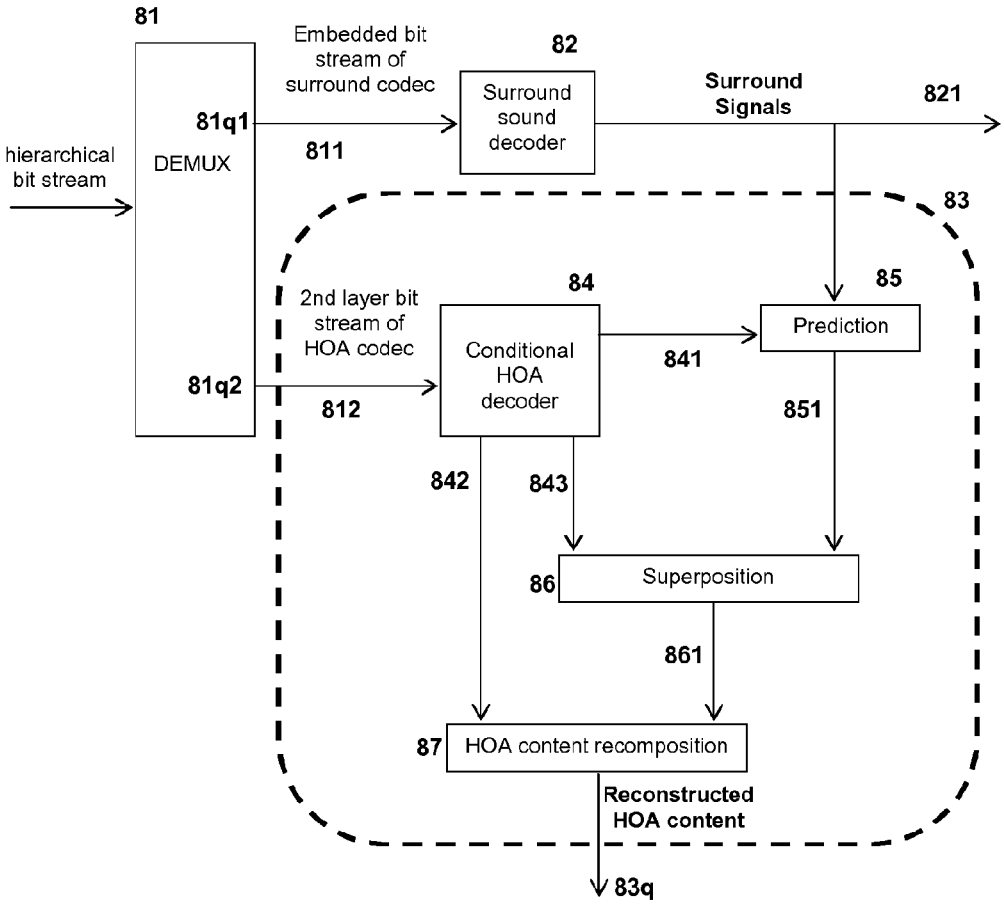
FIG. 8 an exemplary decoder architecture for hierarchical HOA decoding.

FIG. 8 shows an exemplary decoder architecture for hierarchical HOA decoding. A received hierarchical bitstream is input to a demultiplexer 81. The demultiplexer separates the two sub-streams. At one output 81*q*1, the demultiplexer provides the embedded surround sound bitstream 811, which is a conventional encoded surround sound bitstream. On the other output 81*q*2, the demultiplexer provides residuals 812 for the $2^{nd}$ layer bitstream of the HOA codec. The $2^{nd}$ layer bitstream is ignored in conventional decoders that have no HOA decoding block 83. Such HOA decoding block 83 is available in a decoder according to the invention and can handle the $2^{nd}$ layer HOA bitstream. The HOA decoding block 83 comprises a conditional HOA decoder 84, which in one embodiment provides first side information for prediction 841, second side information for HOA recomposition 842 and decoded residual signals 843. The encoded surround sound bitstream is input to a surround sound decoder 82, which provides conventional surround sound signals 821 to an output.

In the HOA decoding block 83, the conventional surround sound signals 821 are used, together with the first side information 841, for predicting sound components in a prediction block 85. The prediction block 85 provides predicted sound components 851 to a superposition block 86. The superposition block 86 performs superposition of the predicted sound components 851 with the decoded residual signals 843 coming from the conditional HOA decoder 84, and provides reconstructed sound components 861 to a HOA content recomposition block 87. The HOA content recomposition block generates a reconstructed HOA signal 83*q* from the reconstructed sound components 861 and the second side information 842, and outputs the reconstructed HOA signal 83*q* on its output. This reconstructed HOA signal 83*q* can then be transmitted, stored, processed or HOA decoded, e.g. in accordance with a given loudspeaker arrangement.

Figure 9:
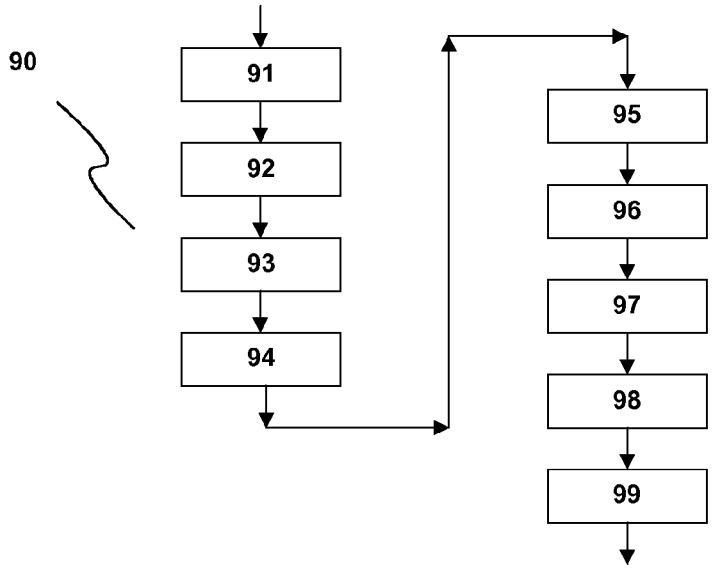
FIG. 9 a flow-chart of a method for encoding.

FIG. 9 shows, in one embodiment, a method 90 for encoding a hierarchical audio bitstream. The method comprises steps of receiving 91 a HOA input signal, rendering 92 the HOA input signal to a surround sound format, wherein a surround sound mix is obtained, encoding 93 the surround sound mix in a surround sound encoder, wherein encoded surround sound is obtained, decoding 94 the encoded surround sound to obtain a reconstructed surround sound signal, performing dimensionality reduction 95 on the received HOA input signal, wherein a dimensionality-reduced HOA signal is obtained that comprises dominant sound components, calculating 96 a difference between the dimensionality-reduced HOA signal and the reconstructed surround sound signal, wherein a residual signal is obtained, encoding 97 the residual signal in a bank of monaural encoders (i.e. a plurality of single-channel encoders, each encoding a dominant sound component), wherein encoded residuals are obtained, obtaining 98 structural information about the HOA input signal in a coder control block, and multiplexing 99 the structural information, the encoded residuals and the encoded surround sound to obtain a hierarchical audio bitstream.

Figure 10:
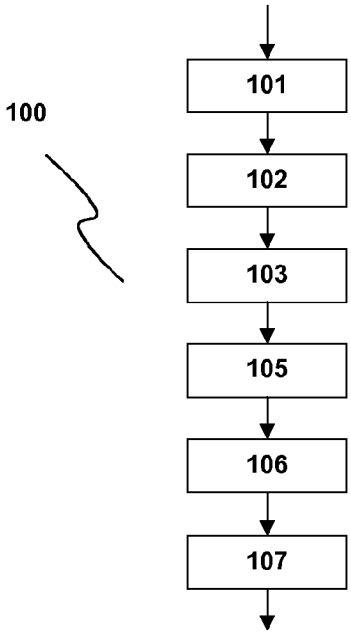
FIG. 10 a flow-chart of a method for decoding.

FIG. 10 shows, in one embodiment, a method 100 for decoding a hierarchical audio bitstream. The method comprises steps of receiving and demultiplexing 101 the hierarchical audio bitstream, wherein at least an embedded surround sound bitstream and a $2^{nd}$ layer HOA bitstream are obtained, the $2^{nd}$ layer HOA bitstream comprising first and second side information and encoded residual signals, decoding 102 the embedded surround sound bitstream to obtain a decoded surround sound bitstream, and decoding 103 the $2^{nd}$ layer bitstream, wherein a reconstructed HOA signal is obtained by steps of predicting 105 sound components using the decoded surround sound bitstream and the first side information, superposing 106 the predicted sound components with the decoded residual signals to obtain reconstructed sound components (or, in principle, reconstructing sound components by superposing or adding a base signal, namely the predicted sound components, and the decoded residual signals), and reconstructing 107 HOA content by recomposing the reconstructed sound components and the second side information, wherein reconstructed HOA content is obtained. The reconstructed HOA content is suitable for obtaining an enhanced audio signal, while the surround signal 82*q* is a base audio signal. In principle, the decoding is suitable for any hierarchical bitstreams generated by either the encoder of FIG. 3 or the encoder of FIG. 7.

The building blocks shown in FIG. 3, FIG. 7 and FIG. 8 as well as the steps of the above methods may be implemented as hardware units, as software units or a mixture thereof. Further, two or more of the building blocks shown may be implemented into a single building block that performs multiple functions.

A use case of hierarchical compression of HOA content with an embedded surround bitstream has been implemented and a stable signal processing concept is ready for further optimization.

A particular benefit in using HOA compression together with a legacy surround codec lies in its efficient, backwards-compatible compression (inherent scalability, coherent representation of full sound field, scheme can integrate sound objects as well). Reduction of data rate of up to roughly 500 kbit/s can be expected for certain mid- to high-bit-rate applications and specific signals.

It will be understood that the present invention has been described purely by way of example, and modifications of detail can be made without departing from the scope of the invention. Each feature disclosed in the description and (where appropriate) the claims and drawings may be provided independently or in any appropriate combination. Features may, where appropriate be implemented in hardware, software, or a combination of the two. Connections may, where applicable, be implemented as wireless connections or wired, not necessarily direct or dedicated, connections. Reference numerals appearing in the claims are by way of illustration only and shall have no limiting effect on the scope of the claims.

The invention claimed is:

1. A method for decoding a hierarchical audio bitstream, comprising steps of receiving and demultiplexing the hierarchical audio bitstream, wherein at least a $1^{st}$ layer bitstream comprising an embedded surround sound bitstream in channel-based coding and a $2^{nd}$ layer bitstream in Higher Order Ambisonics format are obtained, the $2^{nd}$ layer bitstream comprising first and second side information and encoded residual signals, decoding the embedded surround sound bitstream to obtain a decoded surround sound bitstream, and decoding the $2^{nd}$ layer bitstream, wherein a reconstructed Higher Order Ambisonics signal is obtained by steps of predicting sound components using the decoded surround sound bitstream and the first side information, the first side information comprising prediction block parameters, the predicted sound components being intermediate monaural audio signals resulting from a sound field analysis that identifies and extracts dominant sound sources, superposing the predicted sound components with decoded residual signals of the decoded $2^{nd}$ layer bitstream to obtain reconstructed sound components, and reconstructing Higher Order Ambisonics content by recomposing the reconstructed sound components and the second side information to Higher Order Ambisonics format, wherein reconstructed Higher Order Ambisonics content is obtained.

2. The method according to claim 1, wherein said step of predicting uses adaptive predicting, and minimization of a frame-wise energy level of the residual signals is an optimization criterion for said adaptive predicting.

3. The method according to claim 1, wherein said step of predicting uses frequency-dependent adaptive predicting, wherein frame-wise matrix operations with different matrices for different frequency bands are used.

4. A method for encoding a hierarchical audio bitstream, comprising steps of a. receiving a Higher Order Ambisonics input signal;

b. rendering the Higher Order Ambisonics input signal to a surround sound format, wherein a surround sound mix is obtained, c. encoding the surround sound mix in a surround sound encoder, wherein encoded surround sound is obtained;

d. decoding the encoded surround sound to obtain a reconstructed surround sound signal;

e. performing dimensionality reduction on the received Higher Order Ambisonics input signal, wherein a dimensionality-reduced Higher Order Ambisonics signal is obtained;

f. calculating a difference between the dimensionality-reduced Higher Order Ambisonics signal and the reconstructed surround sound signal, wherein a residual signal is obtained;

g. encoding the residual signal in a plurality of monaural perceptual encoders, wherein encoded residuals are obtained;

h. obtaining structural information about the Higher Order Ambisonics input signal in a coder control block; and i. multiplexing the structural information, the encoded residuals and the encoded surround sound into a bitstream to obtain a hierarchical audio bitstream.

5. The method according to claim 4, wherein each of the plurality of monaural perceptual encoders computes an individual perceptual masking threshold for each dominant sound component from a respective original monaural signal.

6. The method according to claim 4, wherein additional sound objects are input to the step of rendering the Higher Order Ambisonics input signal to a surround sound format.

7. An apparatus for decoding a hierarchical audio bitstream, comprising a. demultiplexer adapted for demultiplexing the hierarchical audio bitstream, wherein at least a $1^{st}$ layer bitstream comprising an embedded surround sound bitstream in channel-based coding and a $2^{nd}$ layer bitstream in Higher Order Ambisonics format are obtained, and wherein the $2^{nd}$ layer bitstream comprises first and second side information and encoded residual signals, b. surround sound decoder adapted for decoding the embedded surround sound bitstream to obtain a decoded surround sound bitstream, and c. hierarchical Higher Order Ambisonics decoder adapted for decoding the $2^{nd}$ layer bitstream, wherein the hierarchical Higher Order Ambisonics decoder comprises d. a prediction unit adapted for predicting sound components using the decoded surround sound bitstream and the first side information, the first side information comprising prediction block parameters, the predicted sound components being intermediate monaural audio signals resulting from a sound field analysis that identifies and extracts dominant sound sources, e. a superposition unit adapted for superposing the predicted sound components with decoded residual signals of the decoded $2^{nd}$ layer bitstream to obtain reconstructed sound components, and f. a Higher Order Ambisonics content recomposition unit adapted for reconstructing Higher Order Ambisonics content by recomposing the reconstructed sound components and the second side information to Higher Order Ambisonics format, wherein reconstructed Higher Order Ambisonics content is obtained.

8. The apparatus according to claim 7, further comprising a conditional Higher Order Ambisonics decoder adapted for extracting first side information, second side information and decoded residual signals from the $2^{nd}$ layer Higher Order Ambisonics bitstream.

9. The apparatus according to claim 7, wherein said predicting unit uses adaptive predicting, and minimization of a frame-wise energy level of the residual signals is an optimization criterion for said adaptive predicting.

10. The apparatus according to claim 7, wherein said predicting unit uses frequency-dependent adaptive predicting, wherein frame-wise matrix operations with different matrices for different frequency bands are used.

11. The apparatus according to claim 7, wherein the surround sound decoder uses 5.1 surround format, modified 5.1 surround sound format, Dolby Digital or 7.1 surround sound format.

12. An apparatus for encoding a hierarchical audio bitstream, comprising a. a surround sound renderer block adapted for rendering a Higher Order Ambisonics input signal to a surround sound format, wherein a surround sound mix is obtained, b. a surround sound encoder adapted for encoding the surround sound mix, wherein encoded surround sound is obtained;

c. a surround sound decoder adapted for decoding the encoded surround sound to obtain a reconstructed surround sound signal;

d. a dimensionality reduction unit adapted for performing dimensionality reduction on the Higher Order Ambisonics input signal, wherein a dimensionality-reduced Higher Order Ambisonics signal is obtained;

e. a prediction unit adapted for calculating a difference between the dimensionality-reduced Higher Order Ambisonics signal and the reconstructed surround sound signal, wherein a residual signal is obtained;

f. a plurality of monaural perceptual encoders adapted for encoding the residual signal, wherein each of the plurality of monaural perceptual encoders encodes a residual signal for a particular dominant signal resulting from the dimensionality reduction and wherein encoded residuals are obtained;

g. a coder control block adapted for obtaining structural information about the Higher Order Ambisonics input signal; and h. a multiplexer adapted for multiplexing the structural information, the encoded residuals and the encoded surround sound into a bitstream to obtain a hierarchical audio bitstream.

13. The apparatus according to claim 12, wherein each of the plurality of monaural perceptual encoders for encoding the residual signal uses, for each dominant sound component, an individually computed perceptual masking threshold that is computed from the respective original monaural signal.

14. The apparatus according to claim 12, wherein one or more additional sound objects are input to the surround sound renderer block, and the surround sound renderer block renders the Higher Order Ambisonics input signal and the one or more additional sound objects to a surround sound format.

15. The apparatus according to claim 12, wherein the surround sound encoder uses 5.1 surround format, modified 5.1 surround sound format, Dolby Digital or 7.1 surround sound format.

* * * * *